US011171419B2

(12) United States Patent
Tsai et al.

(10) Patent No.: US 11,171,419 B2
(45) Date of Patent: Nov. 9, 2021

(54) ANTENNA STRUCTURE

(71) Applicant: Quanta Computer Inc., Taoyuan (TW)

(72) Inventors: Chin-Lung Tsai, Taoyuan (TW); Ying-Cong Deng, Taoyuan (TW); Chung-Hung Lo, Taoyuan (TW); Kuan-Hsien Lee, Taoyuan (TW); Yi-Ling Tseng, Taoyuan (TW); Chung-Ting Hung, Taoyuan (TW)

(73) Assignee: QUANTA COMPUTER INC, Taoyuan (TW)

( * ) Notice: Subject to any disclaimer, the term of this patent is extended or adjusted under 35 U.S.C. 154(b) by 96 days.

(21) Appl. No.: 16/747,124

(22) Filed: Jan. 20, 2020

(65) Prior Publication Data

US 2021/0066801 A1 Mar. 4, 2021

(30) Foreign Application Priority Data

Aug. 30, 2019 (TW) ..... 108131157

(51) Int. Cl.
*H01Q 1/24* (2006.01)
*H01Q 5/385* (2015.01)
*H01Q 9/30* (2006.01)

(52) U.S. Cl.
CPC ..... *H01Q 5/385* (2015.01); *H01Q 1/243* (2013.01); *H01Q 9/30* (2013.01)

(58) Field of Classification Search
CPC ..... H01G 1/38; H01G 5/385; H01G 9/30
See application file for complete search history.

(56) References Cited

U.S. PATENT DOCUMENTS

2015/0042517 A1* 2/2015 Chang ..... H01Q 5/385 343/700 MS

FOREIGN PATENT DOCUMENTS

TW 200729612 A 8/2007

OTHER PUBLICATIONS

Chinese language office action dated Mar. 9, 2020, issued in application No. TW 108131157.

* cited by examiner

*Primary Examiner* — Graham P Smith
(74) *Attorney, Agent, or Firm* — McClure, Qualey & Rodack, LLP

(57) ABSTRACT

An antenna structure includes a nonconductive supporting element, a feeding radiation element, a first radiation element, a second radiation element, a third radiation element, and a fourth radiation element. The first radiation element is coupled to a ground voltage. A first coupling gap is formed between the first radiation element and the feeding radiation element. The second radiation element is coupled to the first radiation element. A second coupling gap is formed between the second radiation element and the feeding radiation element. The third radiation element is coupled to the first radiation element. The fourth radiation element is coupled to the ground voltage. A third coupling gap is formed between the fourth radiation element and the feeding radiation element. The feeding radiation element, the first radiation element, the second radiation element, the third radiation element, and the fourth radiation element are all disposed on the nonconductive supporting element.

9 Claims, 3 Drawing Sheets

ANTENNA STRUCTURE

CROSS REFERENCE TO RELATED APPLICATIONS

This application claims priority of Taiwan Patent Application No. 108131157 filed on Aug. 30, 2019, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

BRIEF SUMMARY OF THE INVENTION

In an exemplary embodiment, the disclosure is directed to an antenna structure which includes a nonconductive supporting element, a feeding radiation element, a first radiation element, a second radiation element, a third radiation element, and a fourth radiation element. The feeding radiation element has a feeding point. The first radiation element is coupled to a ground voltage. A first coupling gap is formed between the first radiation element and the feeding radiation element. The second radiation element is coupled to the first radiation element. A second coupling gap is formed between the second radiation element and the feeding radiation element. The third radiation element is coupled to the first radiation element. The fourth radiation element is coupled to the ground voltage. A third coupling gap is formed between the fourth radiation element and the feeding radiation element. The feeding radiation element, the first radiation element, the second radiation element, the third radiation element, and the fourth radiation element are all disposed on the nonconductive supporting element.

In some embodiments, the nonconductive supporting element has a first surface, a second surface, and a third surface. Both the first surface and the third surface are substantially perpendicular to the second surface. The feeding radiation element and the fourth radiation element extend from the first surface onto the second surface. The first radiation element and the third radiation element are disposed on the first surface. The second radiation element extends from the first surface through the second surface onto the third surface.

In some embodiments, the feeding radiation element substantially has a relatively wide L-shape.

In some embodiments, the combination of the first radiation element and the third radiation element substantially has a straight-line shape.

In some embodiments, the second radiation element substantially has a relatively narrow L-shape.

In some embodiments, the antenna structure covers a first frequency band, a second frequency band, a third frequency band, and a fourth frequency band. The first frequency band is from 1700 MHz to 2200 MHz. The second frequency band is from 2300 MHz to 2700 MHz. The third frequency band is from 3300 MHz to 3800 MHz. The fourth frequency band is from 5100 MHz to 5925 MHz.

In some embodiments, the length of the feeding radiation element is substantially equal to 0.25 wavelength of the second frequency band.

In some embodiments, the total length of the first radiation element and the second radiation element is substantially equal to 0.25 wavelength of the first frequency band.

In some embodiments, the total length of the first radiation element and the third radiation element is substantially equal to 0.25 wavelength of the third frequency band.

In some embodiments, the length of the fourth radiation element is substantially equal to 0.25 wavelength of the fourth frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
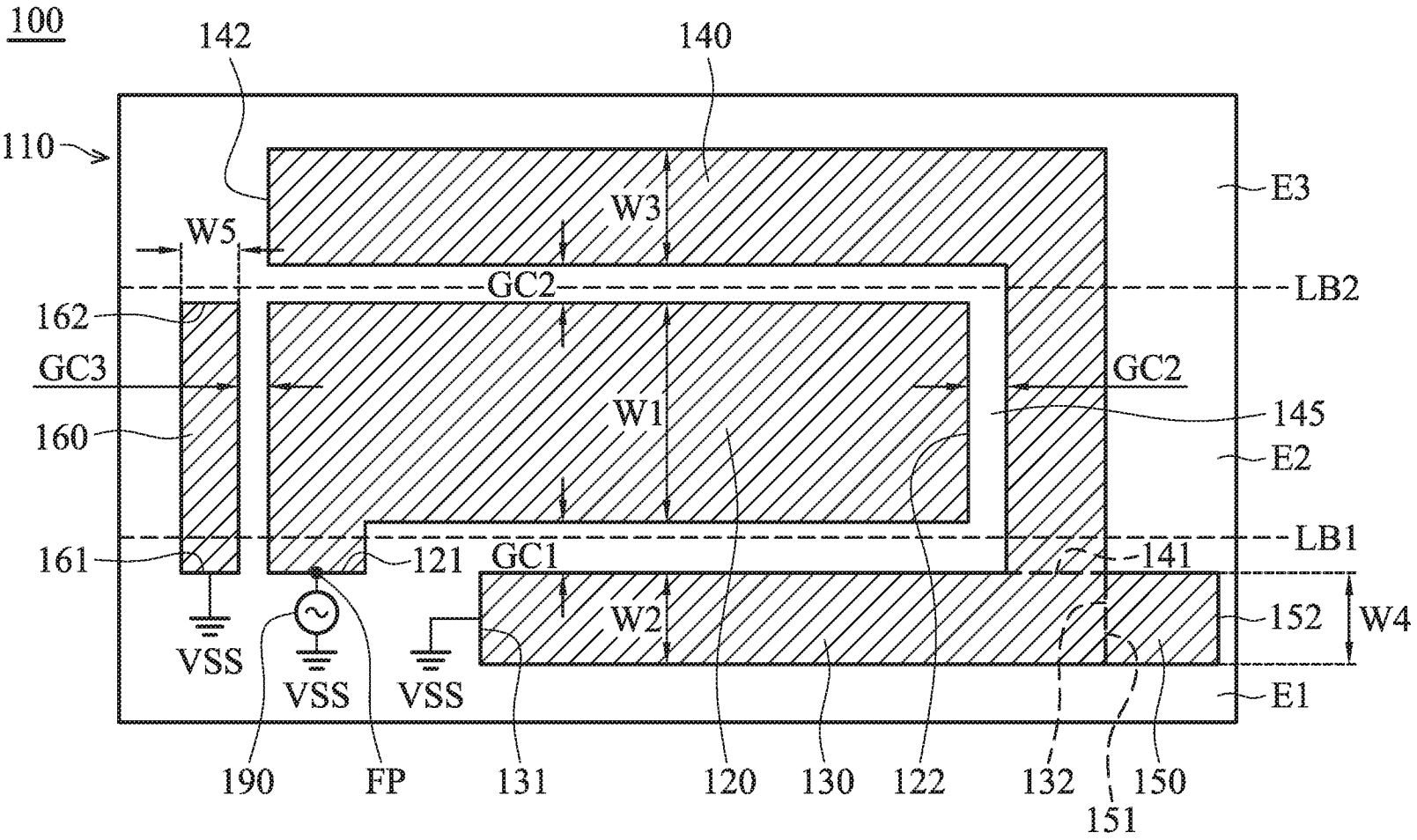
FIG. 1 is a developed view of an antenna structure according to an embodiment of the invention.
Figure 2:
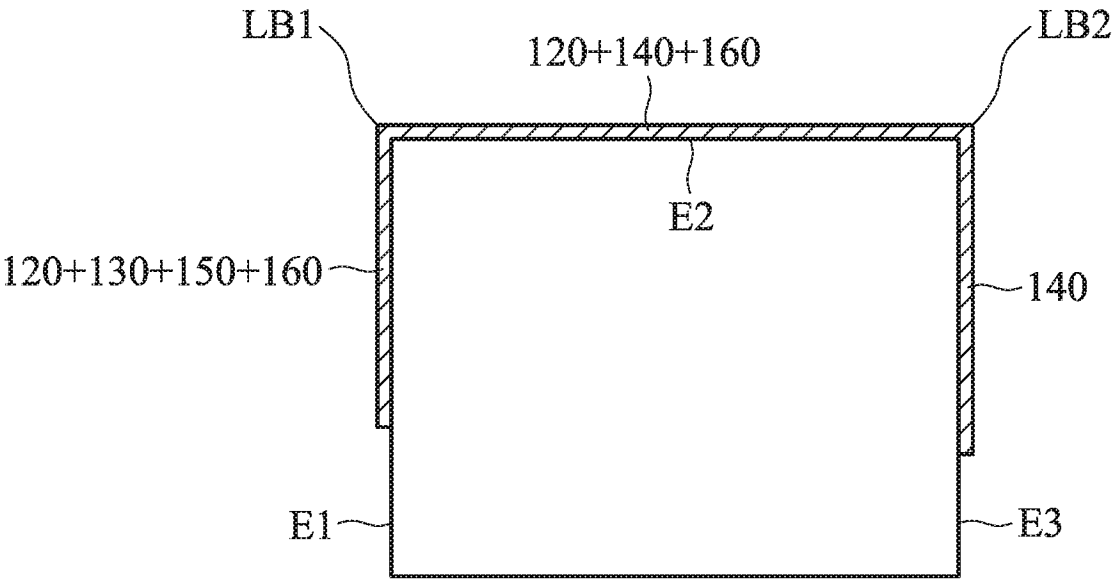
FIG. 2 is a side view of an antenna structure according to an embodiment of the invention.

FIG. 1 is a developed view of an antenna structure 100 according to an embodiment of the invention. The antenna structure 100 has two 90-degree bending lines LB1 and LB2. FIG. 2 is a side view of the antenna structure 100 according to an embodiment of the invention. Please refer to FIG. 1 and FIG. 2 together. The antenna structure 100 may be applied to a wireless access point or a mobile device, such as a smartphone, a tablet computer, or a notebook computer. As shown in FIG. 1 and FIG. 2, the antenna structure 100 at least includes a nonconductive supporting element 110, a feeding radiation element 120, a first radiation element 130, a second radiation element 140, a third radiation element 150, and a fourth radiation element 160. The feeding radiation element 120, the first radiation element 130, the second radiation element 140, the third radiation element 150, and the fourth radiation element 160 may all be made of metal materials, such as copper, silver, aluminum, iron, or their alloys.

The feeding radiation element 120, the first radiation element 130, the second radiation element 140, the third radiation element 150, and the fourth radiation element 160 are all disposed on the nonconductive supporting element 110. Specifically, the nonconductive supporting element 110 has a first surface E1, a second surface E2, and a third surface E3. The first surface E1 and the third surface E3 are substantially parallel to each other. Both the first surface E1 and the third surface E3 are substantially perpendicular to the second surface E2. Both the feeding radiation element 120 and the fourth radiation element 160 extend from the first surface E1 onto the second surface E2 of the nonconductive supporting element 110. Both the first radiation element 130 and the third radiation element 150 are disposed on the first surface E1 of the nonconductive supporting element 110. The second radiation element 140 extends from the first surface E1 through the second surface E2 onto the third surface E3 of the nonconductive supporting element 110.

The feeding radiation element 120 may substantially have a relatively wide L-shape, and it may be completely separate from the first radiation element 130, the second radiation element 140, the third radiation element 150, and the fourth radiation element 160. The feeding radiation element 120 has a first end 121 and a second end 122. A feeding point FP is positioned at the first end 121 of the feeding radiation element 120. The second end 122 of the feeding radiation element 120 is an open end. The feeding point FP may be coupled to a signal source 190, such as an RF (Radio Frequency) module, for exciting the antenna structure 100. Specifically, the first end 121 of the feeding radiation element 120 is positioned on the first surface E1 of the nonconductive supporting element 110. The second end 122 of the feeding radiation element 120 is positioned on the second surface E2 of the nonconductive supporting element 110.

The first radiation element 130 may substantially have an equal-width straight-line shape, and it may be at least partially parallel to the feeding radiation element 120. The first radiation element 130 has a first end 131 and a second end 132. The first end 131 of the first radiation element 130 is coupled to a ground voltage VSS. The first radiation element 130 is adjacent to the feeding radiation element 120. A first coupling gap GC1 is formed between the first radiation element 130 and the feeding radiation element 120. It should be noted that the term "adjacent" or "close" over the disclosure means that the distance (spacing) between two corresponding elements is smaller than a predetermined distance (e.g., 5 mm or shorter), but usually does not mean that the two corresponding elements are touching each other directly (i.e., the aforementioned distance/spacing therebetween is reduced to 0).

The second radiation element 140 may substantially have a relative-narrow L-shape, and it may be at least partially parallel to the feeding radiation element 120. The second radiation element 140 has a first end 141 and a second end 142. The first end 141 of the second radiation element 140 is coupled to the second end 132 of the first radiation element 130. The second end 142 of the second radiation element 140 is an open end. The second end 142 of the second radiation element 140 and the second end 122 of the feeding radiation element 120 may substantially extend in opposite directions. The second radiation element 140 is adjacent to the feeding radiation element 120. A second coupling gap GC2 is formed between the second radiation element 140 and the feeding radiation element 120. Specifically, the first end 141 of the second radiation element 140 is positioned on the first surface E1 of the nonconductive supporting element 110. The second end 142 of the second radiation element 140 is positioned on the third surface E3 of the nonconductive supporting element 110. In some embodiments, a slot region 145 is formed between the first radiation element 130 and the second radiation element 140. The slot region 145 has an open side and a closed side. The second end 122 of the feeding radiation element 120 extends into the slot region 145. In alternative embodiments, adjustments may be made so that the slot region 145 substantially has an L-shape.

The third radiation element 150 may substantially have a rectangular shape or a square shape. The combination of the first radiation element 130 and the third radiation element 150 may substantially have an equal-width straight-line shape. The third radiation element 150 has a first end 151 and a second end 152. The first end 151 of the third radiation element 150 is coupled to the second end 132 of the first radiation element 130. The second end 152 of the third radiation element 150 is an open end. The second end 152 of the third radiation element 150 and the second end 122 of the feeding radiation element 120 may extend in the same direction.

The fourth radiation element 160 may substantially have a straight-line shape, and it may be at least partially parallel to the feeding radiation element 120. The fourth radiation element 160 has a first end 161 and a second end 162. The first end 161 of the fourth radiation element 160 is coupled to the ground voltage VSS. The second end 162 of the fourth radiation element 160 is an open end. The fourth radiation element 160 is adjacent to the feeding radiation element 120. A third coupling gap GC3 is formed between fourth radiation element 160 and the feeding radiation element 120. Specifically, the first end 161 of the fourth radiation element 160 is positioned on the first surface E1 of the nonconductive supporting element 110. The second end 162 of the fourth radiation element 160 is positioned on the second surface E2 of the nonconductive supporting element 110.

Figure 3:
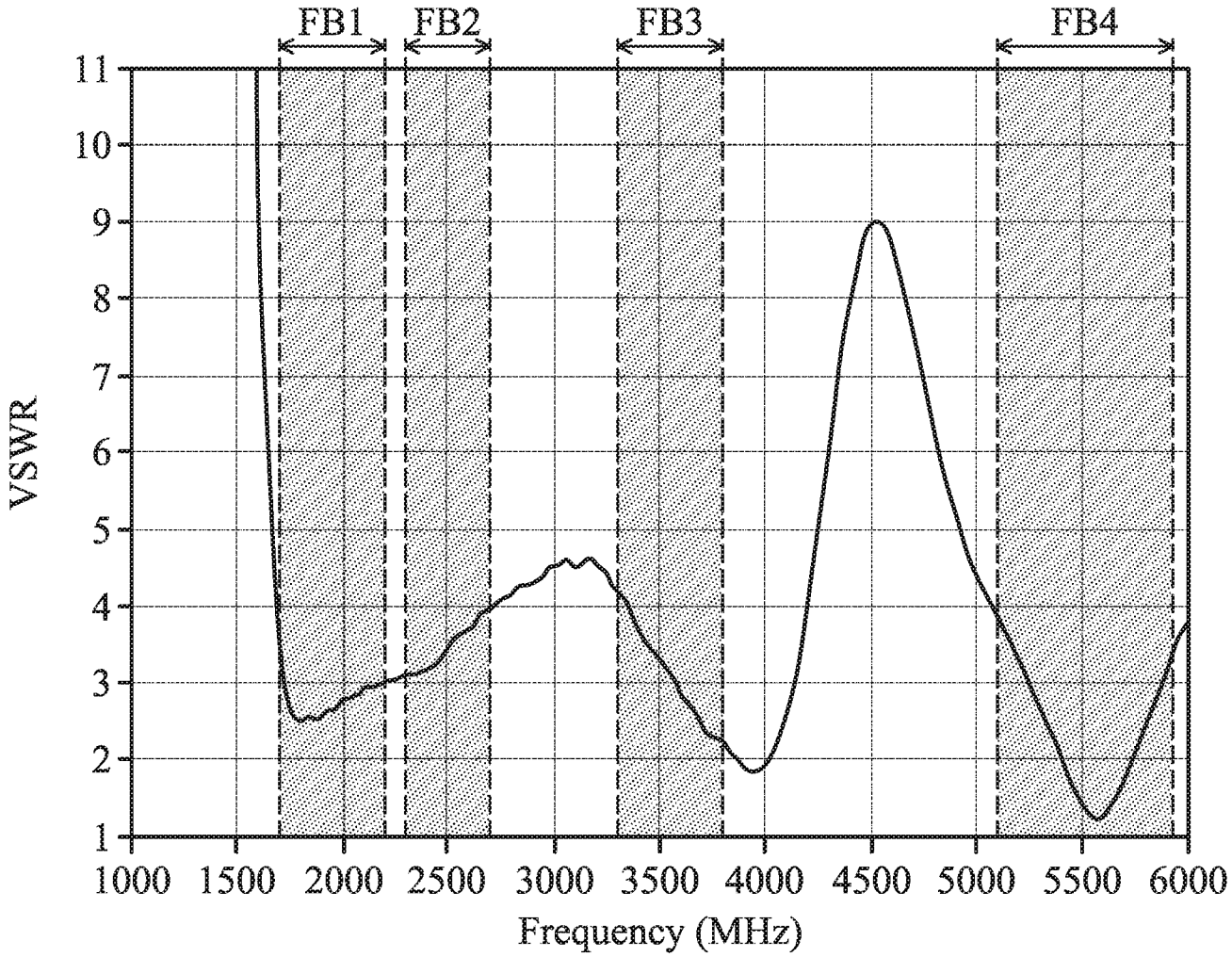
FIG. 3 is a diagram of VSWR (Voltage Standing Wave Ratio) of an antenna structure according to an embodiment of the invention.

FIG. 3 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 3, the antenna structure 100 can cover a first frequency band FB1, a second frequency band FB2, a third frequency band FB3, and a fourth frequency band FB4. For example, the first frequency band FB1 may be from 1700 MHz to 2200 MHz. The second frequency band FB2 may be from 2300 MHz to 2700 MHz. The third frequency band FB3 may be from 3300 MHz to 3800 MHz. The fourth frequency band FB4 may be from 5100 MHz to 5925 MHz. Accordingly, the antenna structure 100 can support at least wideband operations of the next-generation 5G communication.

In some embodiments, the operation principles of the antenna structure 100 are described as follows. The feeding radiation element 120 is excited to generate the second frequency band FB2. Each of the first radiation element 130, the second radiation element 140, the third radiation element 150, and the fourth radiation element 160 is excited by the feeding radiation element 120 using a coupling mechanism. The first radiation element 130 and the second radiation element 140 are excited to generate the first frequency band FB1. The first radiation element 130 and the third radiation element 150 are excited to generate the third frequency band FB3. The fourth radiation element 160 is excited to generate the fourth radiation element FB4.

In some embodiments, the element sizes of the antenna structure 100 are described as follows. The length of the feeding radiation element 120 (i.e., the length from the first end 121 to the second end 122) may be substantially equal to 0.25 wavelength ($\lambda/4$) of the second frequency band FB2 of the antenna structure 100. The total length of the first radiation element 130 and the second radiation element 140 (i.e., the total length from the first end 131 through the first end 141 to the second end 142) may be substantially equal to 0.25 wavelength ($\lambda/4$) of the first frequency band FB1 of the antenna structure 100. The total length of the first radiation element 130 and the third radiation element 150 (i.e., the total length from the first end 131 through the first end 151 to the second end 152) may be substantially equal to 0.25 wavelength ($\lambda/4$) of the third frequency band FB3 of the antenna structure 100. The length of the fourth radiation element 160 (i.e., the length from the first end 161 to the second end 162) may be substantially equal to 0.25 wavelength ($\lambda/4$) of the fourth frequency band FB4 of the antenna structure 100. The width W1 of the feeding radiation element 120 may be greater than the width W2 of the first radiation element 130, the width W3 of the second radiation element 140, the width W4 of the third radiation element 150, and the width W5 of the fourth radiation element 160. For example, the width W1 of the feeding radiation element 120 may be at least two times the width W2 of the first radiation element 130. The width W2 of the first radiation element 130, the width W3 of the second radiation element 140, and the width W4 of the third radiation element 150 may be substantially the same. The width W1 of the feeding radiation element 120 may be at least three times the width W5 of the fourth radiation element 160. The width of each of the first coupling gap GC1, the second coupling gap GC2, and the third coupling gap GC3 may be smaller than or equal to 2 mm. The above ranges of element sizes are calculated and obtained according to many experiment results, and they help to optimize the operation bandwidth and impedance matching of the antenna structure 100.

The invention proposes a novel wideband antenna structure, whose radiation elements are distributed over a 3D (Three-Dimensional) nonconductive supporting element so as to minimize the total antenna size. Generally, the invention has at least the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-3. The invention may merely include any one or more features of any one or more embodiments of FIGS. 1-3. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a nonconductive supporting element;

a feeding radiation element, having a feeding point;

a first radiation element, coupled to a ground voltage, wherein a first coupling gap is formed between the first radiation element and the feeding radiation element;

a second radiation element, coupled to the first radiation element, wherein a second coupling gap is formed between the second radiation element and the feeding radiation element;

a third radiation element, coupled to the first radiation element; and a fourth radiation element, coupled to the ground voltage, wherein a third coupling gap is formed between the fourth radiation element and the feeding radiation element;

wherein the feeding radiation element, the first radiation element, the second radiation element, the third radiation element, and the fourth radiation element are all disposed on the nonconductive supporting element;

wherein a combination of the first radiation element and the third radiation element substantially has a straight-line shape.

2. The antenna structure as claimed in claim 1, wherein the nonconductive supporting element has a first surface, a second surface, and a third surface, both the first surface and the third surface are substantially perpendicular to the second surface, the feeding radiation element and the fourth radiation element extend from the first surface onto the second surface, the first radiation element and the third radiation element are disposed on the first surface, and the second radiation element extends from the first surface through the second surface onto the third surface.

3. The antenna structure as claimed in claim 1, wherein the feeding radiation element substantially has a relatively wide L-shape.

4. The antenna structure as claimed in claim 1, wherein the second radiation element substantially has a relatively narrow L-shape.

5. The antenna structure as claimed in claim 1, wherein the antenna structure covers a first frequency band, a second frequency band, a third frequency band, and a fourth frequency band, the first frequency band is from 1700 MHz to 2200 MHz, the second frequency band is from 2300 MHz to 2700 MHz, the third frequency band is from 3300 MHz to 3800 MHz, and the fourth frequency band is from 5100 MHz to 5925 MHz.

6. The antenna structure as claimed in claim 5, wherein a length of the feeding radiation element is substantially equal to 0.25 wavelength of the second frequency band.

7. The antenna structure as claimed in claim 5, wherein a total length of the first radiation element and the second radiation element is substantially equal to 0.25 wavelength of the first frequency band.

8. The antenna structure as claimed in claim 5, wherein a total length of the first radiation element and the third radiation element is substantially equal to 0.25 wavelength of the third frequency band.

9. The antenna structure as claimed in claim 5, wherein a length of the fourth radiation element is substantially equal to 0.25 wavelength of the fourth frequency band.

* * * * *